US005309203A

United States Patent [19]

Hokari

[11] Patent Number: 5,309,203

[45] Date of Patent: May 3, 1994

[54] BELT-TYPE IMAGE FORMING APPARATUS HAVING VIBRATION RESISTANCE

[75] Inventor: Norio Hokari, Kanagawa, Japan

[73] Assignee: Fuji Xerox Co., Ltd., Tokyo, Japan

[21] Appl. No.: 19,353

[22] Filed: Feb. 18, 1993

[30] Foreign Application Priority Data

Feb. 19, 1992 [JP] Japan ..... 4-69665

[51] Int. Cl.[5] ..... G03G 15/00

[52] U.S. Cl. ..... 355/212; 355/200; 355/326

[58] Field of Search ..... 355/212, 271–276, 355/326, 327, 200

[56] References Cited

U.S. PATENT DOCUMENTS 3,796,488 3/1974 Tanaka et al. ..... 355/212
3,974,952 8/1976 Swanke et al. ..... 355/212
5,160,946 11/1992 Hwang ..... 355/327 X

FOREIGN PATENT DOCUMENTS 59-168467 9/1984 Japan .
1-312577 12/1989 Japan .

*Primary Examiner*—R. L. Moses
*Attorney, Agent, or Firm*—Finnegan, Henderson Farabow, Garrett & Dunner

[57] ABSTRACT

In an image forming apparatus such as a copying machine, a belt member is put across a driving roll and a tension roll, and springs provided on the tension roll give a tension to the belt member in order to part the tension roll from the driving roll. A spring constant of the springs is defined so as to absorb vibration of the belt member due to the eccentric rotation of the roll.

11 Claims, 2 Drawing Sheets

BELT-TYPE IMAGE FORMING APPARATUS HAVING VIBRATION RESISTANCE

BACKGROUND OF THE INVENTION

This invention, which is used in an apparatus such as an electrophotographic copying machine, relates to a device for giving a tension to a beltlike photoreceptor, to a belt device running in an image transfer portion with carrying a paper or to a belt device as an intermediate transfer member for transferring a toner image formed on a photoreceptor to a paper. Especially, the invention relates to a device capable of absorbing vibration and uneven driving speed of the belt in accordance with rotation of a driving roll and a tension roll.

As the electrophotographic copying machine, in an image forming apparatus which forms copied papers with the electrophotographic method, a photoreceptor dram is used as an image carrier. The image forming apparatus has a mechanism which transfers the toner image formed on the image carrier onto a paper and fuses the image on the paper through a fusing device, to output the copied paper. On the other hand, the image forming apparatus sometimes employs another mechanism in which a beltlike photoreceptor is used as the image carrier, the elements constituting the electrophotographic system are provided with respect to the beltlike photoreceptor, and then the toner image formed on the photoreceptor is transferred to the paper to obtain the copied paper.

As described above, for example, an electrophotographic copying machine having a beltlike photoreceptor has been known as disclosed in Japanese Patent Unexamined Publication No. Hei. 1-312577. A color electronic copying machine has been described in Japanese Patent Unexamined Publication No. Sho. 59-168467, which discloses that the paper is transported in accordance with a plurality of image transfer portions under a condition in which the belt member supports the paper. The color electronic copying machine, described in the prior art, employs a plurality of image forming units for forming a color image, which are arranged along the belt member carrying the paper, and the color toner images are transferred from the image forming units to the paper superimposingly during the movement of the paper.

As described above, in the image forming apparatus with the belt member, the belt member is put across a driving roll and a roll for giving the tension, and the belt member is driven at constant speed. However, even if length and width of the belt of the apparatus are constituted strictly, the belt member can not move at constant speed under conditions in which both an axis of a roll member for driving the belt and a circumference portion contacting with the belt are not formed with the same diameter circle exactly in a direction of the belt width.

The driving roll and the tension roll are produced by machine processing, molding processing and grinding the roll member, however, an axis center of the circumference portion contacting with the belt does not always agree with that of an axis member. In addition, in case of driving the roll and the belt member, it can not be avoided that a vibration is occurred on the belt member in accordance with an eccentricity quantity of the roll. In the belt apparatus, the driving roll is held to be arranged at a fixed position to a supporting frame, and the tension roll is supported though a tension giving member, such as a spring, giving a constant tension to the belt.

Now, presuming that the tension roll is arranged immovably and is held by the frame with giving constant tension. The vibration generates and has an influence to the belt member, and the belt expands and contracts in accordance with the eccentricity of the tension roll. The influence of expansion and contraction of the belt depends on materials and size of the belt, position of the belt, the eccentricity quantity of the roll member, and twining angle of the belt to the roll. In addition, in an apparatus such as a general belt driving apparatus in which the belt member is put across the driving roll and the tension roll so that the belt is moved by driving the driving roll, the tension roll is constituted to be movable in a tension giving direction by employing a spring or the like, so that the influence according to the eccentricity of the roll member is reduced. However, as described above, even if the tension giving device is provided movably, a variation of speed at a transporting surface or an action surface of the belt affects the image forming operation because of transport load of the tension giving device and a spring constant of a spring member for giving tension.

On the other hand, for example, as disclosed in Japanese Patent Unexamined Publication No. Sho. 59-168467, the color electronic copying machine employs a method in which color toner images formed by a plurality of image forming units are transferred sequentially and superimposingly to the paper. In the apparatus described on the prior art, two rolls provided at both sides of the belt member are used as driving rolls and both rolls are driven synchronously. However, as described above, even if a roll having the tension giving device and driving roll are constituted to have the same diameter and driven synchronously, the driving radiuses to the belt are different at each position of the rolls, and then expansion and contraction of the belt appears in different manners. Accordingly, when the color images are transferred to the paper superimposingly under a condition of holding the paper on the belt member, the color toner images slip out of place to deteriorate the image quality of the color copy.

SUMMARY OF THE INVENTION

The invention has an object to prevent an image slipping according to the influence of the vibration of the belt member in a paper transporting device employing the belt member at an image transfer portion, an apparatus constituted as an intermediate carrier carrying the toner image or a beltlike photoreceptor, and to supply an apparatus preventing a vibration of the belt member by setting a spring constant of the tension spring of the tension giving device and a condition of moving load of the tension giving device.

In order to attain the above object, the invention provides a belt device in an image forming apparatus including an endless belt member; a driving roll, provided at one end of running direction of the belt which forms an action surface of the belt device, for driving the endless belt; a driving unit for driving the driving roll; a tension giving member, provided at another end of running direction of the belt, for giving a tension to the endless belt; and supporting frames for supporting the driving roll and the tension giving mamber.

Also the invention provides an image forming apparatus including: a frame member; a plurality of roll members provided on the frame member; an endless belt put across the roll members; a plurality of image forming units arranged opposite the endless belt; and a tension giving member, provided on the frame, for giving a tension to the endless belt, wherein toner images formed by the plurality of image forming units are transferred to a paper sequentially on the endless belt while matching positions of the toner images on the paper.

BRIEF DESCRIPTION OF THE DRAWINGS

The accompanying drawings, which are incorporated in and constitute a portion of the specification, illustrate an embodiment of the invention and, together with the description, serve to explain the objects, advantages and principles of the invention. In the drawings.

DETAILED DESCRIPTION OF THE PREFERRED EMBODIMENT

Figure 1:
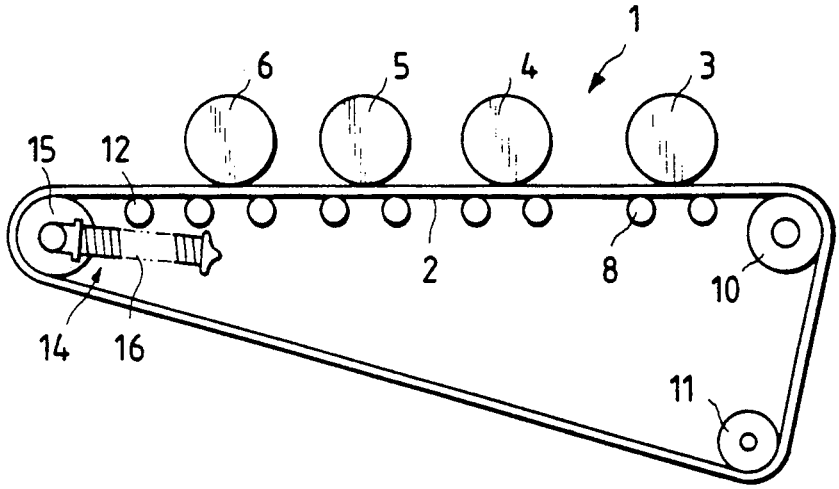
FIG. 1 is a side view of a belt member apparatus employed in an electronic copying machine.

A preferred embodiment of the invention will be described with reference to the accompany drawings. An embodiment shown in FIGS. 1 and 2 indicates an image forming apparatus 1 of a color electronic copying machine. In the image forming apparatus 1, image forming unit 3–6 for forming color toner images are arranged along a path of a belt member 2 and the color toner images formed in the image forming units are transferred superimposingly to a paper held by the belt member 2. Each of the image forming units 3–6 has a photoreceptor and a developing unit. A driving roll 10, an idler roll 11, a driven roll 12 and a tension roll 15 are arranged to drive and guide the belt member 2. Then the belt member 2 is driven by the driving roll 10 under the condition in which a suitable tension is given to the belt member 2 by a tension giving device 14 having the tension roll 15.

In the image forming apparatus 1, a plurality of roll members arranged along a moving path of the belt member 2 are supported by frames 7 and 7*a* of the image forming apparatus and the driving roll 10 is driven by a driving mechanism (not shown). In addition, it is possible that the driving roll 10 and the tension roll 15 are driven together if a driving mechanism is connected with the tension roll 15. Supporting rolls 8 are arranged at image transferring portions of the plurality of image forming units 3–6 to support an underface of the belt member 2, and toner images formed on the photoreceptor drums of the image forming units are transferred to a paper with providing transfer corotrons (not shown) and the like.

Figure 2:
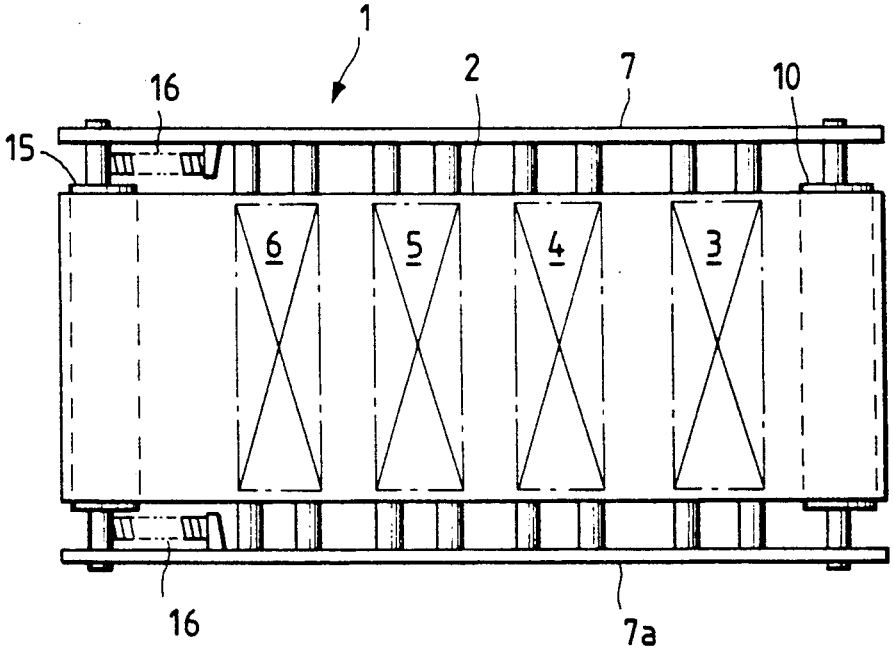
FIG. 2 is a plan view of the belt member apparatus shown in FIG. 1.

In FIG. 2, the tension roll 15 is supported through springs 16 and is provided movably to the frames 7 and 7*a*. As a general axis supporting mechanism of a tension roll, any arrangement can be selected so that the tension roll 15 is supported slidably to the frames. In this embodiment, the tension roll 15 is urged in a direction apart from the driving roll 10 with a method of pushing the tension roll 15 by the springs 16 so that the belt member is given a constant tension. Besides, in this embodiment, compressing springs are provided at the tension roll, however, any elastic member such as an extension spring or a torsion spring can be employed as the tension giving member.

Figure 3:
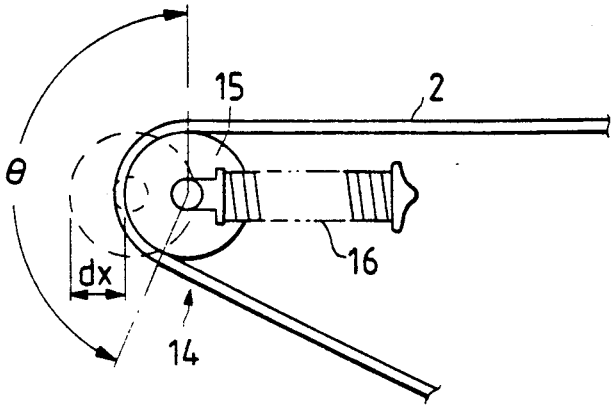
FIG. 3 is an explanatory view of a tension giving device of the invention.

In the image forming apparatus constituted as described above, examination to give tension to the belt member 2 by the tension roll 15 will be described hereinafter. As shown in FIG. 3, the belt member 2 is twined around the tension roll 15 at angle of $\theta$, and the tension roll 15 is given a tension by the springs 16. In the model shown in FIG. 3, defining that a spring constant of the belt member 2 is $k_1$ and a spring constant of the springs 16 is k, then the model is replaced with a simplified model shown in FIG. 4 and both spring constants are set as $k<k_1$. In addition, the spring constant of the spring 16 is required so as to absorb the vibration of the belt member 2.

Figure 4:
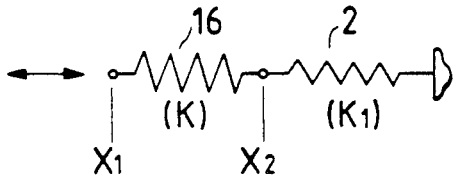
FIG. 4 is a simple model of the device shown in FIG. 3.

In the model as shown in FIG. 4, when assuming that the belt member 2 is displaced by $\pm dx$ depending on vibration of the tension roll 15, a displacement quantity of point $x_1$ is $dx_1$ and a displacement quantity of point $x_2$ is $dx_2$, and then $dx_1>dx_2$. A force dF actioning upon two spring members connected in series is expressed by; $dF=dx_1\times k=dx_2\times k_1$, and $dx_2=dx_1\times(k/k_1)$.

Now, for example, assuming that the interval (action length of the belt member) between the driving roll 15 and the tension roll 10 is L, description will be made of the case that displacement quantity of position of the belt member is less than X($\mu$m) at each image forming unit. The displacement quantity of the belt member can be treated as frequent quantity since it is generated in accordance with rotation of the tension roll. When the displacement quantity of the belt member is X($\mu$m), a one-side sine wave whose amplitude is X/2 is generated. In addition, assuming that displacement quantity with rotation of the tension roll is $\pm$Y(mm), the following expressions are obtained.

$$dx_2=dx_1(k/k_1)<X/2\times10^{-3} \quad (1)$$

$$dx_1=Y(mm) \quad (2)$$

Here, expansion quantity of the belt member at point $x_2$ is dL with respect to the action length L of the belt member, the following expressions are obtained.

$$\sigma=E\epsilon \text{ (E: Young's modulus, } \sigma\text{: stress, } \epsilon\text{: distortion)} \quad (3)$$

$$\sigma=W/A \text{ (W: weight, A: sectional area)} \quad (4)$$

$$\epsilon=dL/L \text{ (distortion=expansion quantity/original length)} \quad (5)$$

$$k_1=W/dL \text{ (spring constant=weight/displacement quantity)} \quad (6)$$

From the above expressions (3)–(5), $$k_1=W/dL=EA/L. \quad (7)$$

Further, the expression (1) is rewrite as $$k<(X/2\times10^{-3}\times k_1)/dx_1 \quad (8)$$

and, by substituting the expression (7) for the expression (8), $$k<(X/2\times10^{-3}\times EA)/(dx_1\times L). \quad (9)$$

Further more, by substituting the expression (2) for the expression (9), $$k<(XEA\times10^{31\ 3})/(2YL) \quad (10)$$

where k is spring constant (Kgf/mm) of the tension giving device, $k_1$ is spring constant (Kgf/mm) of the action surface of the belt member, X is allowable displacement quantity of the belt member corresponding to the image forming unit, E is Young's modulus of the belt member, A is sectional area ($cm^2$), and Y is displacement quantity (mm) of the tension roll.

The spring constant k should be determined as described above so that the displacement quantity is less than X(mm).

In the above case, since the spring constant $k_1$ of the action surface of the belt member is expressed as $k_1=EA/L$, $k/k_1=X/200$. Consequently, when the allowable displacement quantity X is about 4 μm, the spring constant k should be $k_1/50$. It is a desirable range that the allowable displacement quantity is less than 4 μm. The displacement quantity is different in any devices, and generally, the quantity should be less than 30 μm. In this case, the spring constant k is set to about 3/20. To put it concretely, when a fluoride belt member (Young's modulus: 200, action length: 755, sectional area: 34) is employed as the belt member, $k_1$ is 9 Kgf/mm and k should be 0.045 Kgf/mm because of $k=k_1/200$ so that X may be less than 1 μm.

Figure 5:
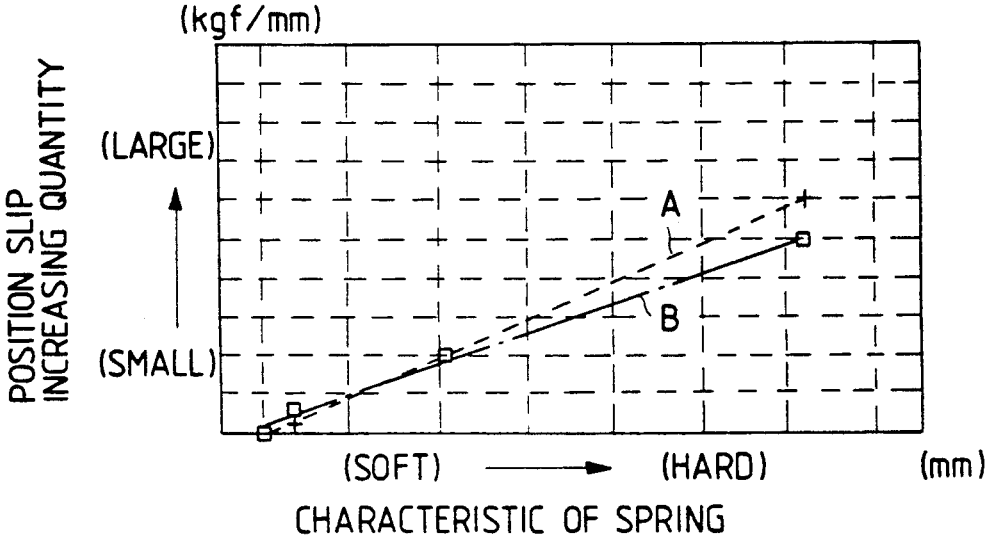
FIG. 5 is a graph indicating experimental values and calculational values in the apparatus of the invention.

A graph, shown in FIG. 5, indicates a comparison of a result calculated by the above-described manner with a result read out from a copy in practice. In FIG. 5, Y indicates position slip increasing quantity at the vertical axis and characteristic of the spring is indicated at the horizontal axis. In this graph, a line A indicates a value of the calculated result and a line B indicates a value of the read out result, and those lines are approximate. Therefore, the vibration problem on the paper supporting belt member can be solved by the tension giving spring having the above-described characteristic.

The above-described embodiment of the invention explained the belt member device which supports the paper and transfers the color toner images to the paper sequentially and superimposingly, and further the invention may be applied to a beltlike photoreceptor or an intermediate transferring belt. In use of, the beltlike photoreceptor, the invention can also prevent image slipping depending on the vibration of the belt member in a toner image formed on the photoreceptor.

In the invention, as described above, suitable tension is given to the tension roll for driving the belt member by the tension giving device, so that it is possible to absorb the vibration of the belt member if the belt member vibrates due to the eccentricity of the roll member. When the toner images are transferred to the paper superimposingly, the paper can be positioned exactly at each image transfer portion, and a fine quality copy is produced preventing shifting of the toner image formed. In addition, the tension giving device of the invention, comparing with the general tension giving device of the belt member, does not have a complicated constitution and the only thing required is to set the value of tension of the spring appropriately, so that it makes the mechanism of the tension giving device simple.

What is claimed is:

1. A belt device in an image forming apparatus comprising:

an endless belt member;

driving roll means, provided at one end of running direction of said belt which forms an action surface of said belt device, for driving said endless belt;

driving means for driving said driving roll means;

tension giving means, provided at another end of running direction of said belt, for giving a tension to said endless belt; and supporting means for supporting said driving roll means and said tension giving means, wherein a spring constant of the action surface of the endless belt member is $k_1$ and a spring constant of said tension giving means is k, which are defined as:

$$k_1=EA/L$$

$$k<(XEA\times10^{-3})/(2YL)$$

where X (μm) is allowable displacement quantity of said belt member corresponding to an image forming unit, E is Young's modulus of said belt member, A is sectional area (cm2), of said belt member, Y is displacement quantity (mm) of said tension roll means and L (mm) is original length of said belt.

2. The belt device as claimed in claim 1, wherein said tension giving means comprises two tension spring means and a tension roll means.

3. The belt device as claimed in claim 1, wherein said driving means drives said tension roll means.

4. The belt device as claimed in claim 2, wherein each of said two tension spring means is provided at each end of said roll means.

5. The belt device as claimed in claim 4, wherein said tension roll means is slidable with respect to said supporting means.

6. The belt device as claimed in claim 1, wherein said spring constant k of said tension giving means is less than 1/50 of said spring constant $k_1$ of the action surface of said endless belt member.

7. An image forming apparatus comprising:

a frame member;

a plurality of roll members provided on said frame member;

an endless belt put across said roll members;

a plurality of image forming units arranged opposite said endless belt; and tension giving means, provided on said frame, for giving a tension to said endless belt, wherein toner images formed by said plurality of image forming units are transferred to a paper sequentially on said endless belt while matching positions of said toner images on the paper, and wherein a spring constant of the action surface of the endless belt is $k_1$ and a spring constant of said tension giving means is k, which are defined as:

$$k_1=EA/L$$

$$k<(XEA\times10^{-3})/(2YL)$$

where X (μm) is allowable displacement quantity of said belt member corresponding to the image forming unit, E is Young's modulus of said belt member, A is sectional area ($cm^2$), of said belt member Y is displacement quantity (mm) of said tension roll means and L (mm) is original length of said belt.

8. The image forming apparatus as claimed in claim 7, wherein said tension giving means comprises two tension spring means and a tension roll means.

9. The image forming apparatus as claimed in claim 7, wherein each of said two tension spring means is provided at each end of said tension roll means.

10. The image forming apparatus as claimed in claim 8, wherein said tension roll means is slidable with respect to said frame member.

11. The image forming apparatus as claimed in claim 7, wherein said spring constant k of said tension giving means is less than 1/50 of said spring constant $k_1$ of the action surface of said endless belt.

* * * * *

UNITED STATES PATENT AND TRADEMARK OFFICE

CERTIFICATE OF CORRECTION

PATENT NO. : 5,309,203

DATED : May 03, 1994

INVENTOR(S) : Norio Hokari

It is certified that error appears in the above-indentified patent and that said Letters Patent is hereby corrected as shown below:

Claim 7, column 6, line 66, after "member" insert --,--.

Claim 1, column 6, line 24, change "(cm2)" to --($cm^2$)--.

Signed and Sealed this

Fifteenth Day of November, 1994

*Attest:*

Bruce Lehman

BRUCE LEHMAN

*Attesting Officer*

*Commissioner of Patents and Trademarks*